United States Patent [19]

Miceli

[11] 3,942,402

[45] Mar. 9, 1976

[54] DRAPERY SIZING APPARATUS

[76] Inventor: John J. Miceli, 5644 W. Diversey, Chicago, Ill. 60639

[22] Filed: Apr. 22, 1974

[21] Appl. No.: 462,860

[52] U.S. Cl. ..... 83/418; 83/422; 83/433; 83/435.2

[51] Int. Cl.[2] ..... B26D 1/22

[58] Field of Search ..... 83/433, 435.2, 426, 422, 83/424, 418, 420, 508

[56] References Cited

UNITED STATES PATENTS

| | | | |
|---|---|---|---|
| 1,137,726 | 4/1915 | Taylor | 83/422 X |
| 3,194,102 | 7/1965 | Jarnagin | 83/433 X |
| 3,768,101 | 10/1973 | Kuts | 83/433 X |
| 3,791,247 | 2/1974 | Pretz | 83/433 X |

*Primary Examiner*—J. M. Meister
*Attorney, Agent, or Firm*—Philip T. Liggett

[57] ABSTRACT

A movable table-like surface formed from a continuous loop-belt member is provided to carry drapery material along a straight edge which keeps the material in a proper squared alignment as it is conveyed in a time-saving manner to a cutter that is adjustably movable along the edge of the belt member. The cutter is mounted on track means that is at a right angle with respect to the straight edge and the movement of the material on the belt such that any desired length of material can be cut off as measured from the straight edge.

6 Claims, 5 Drawing Figures

Figure 1
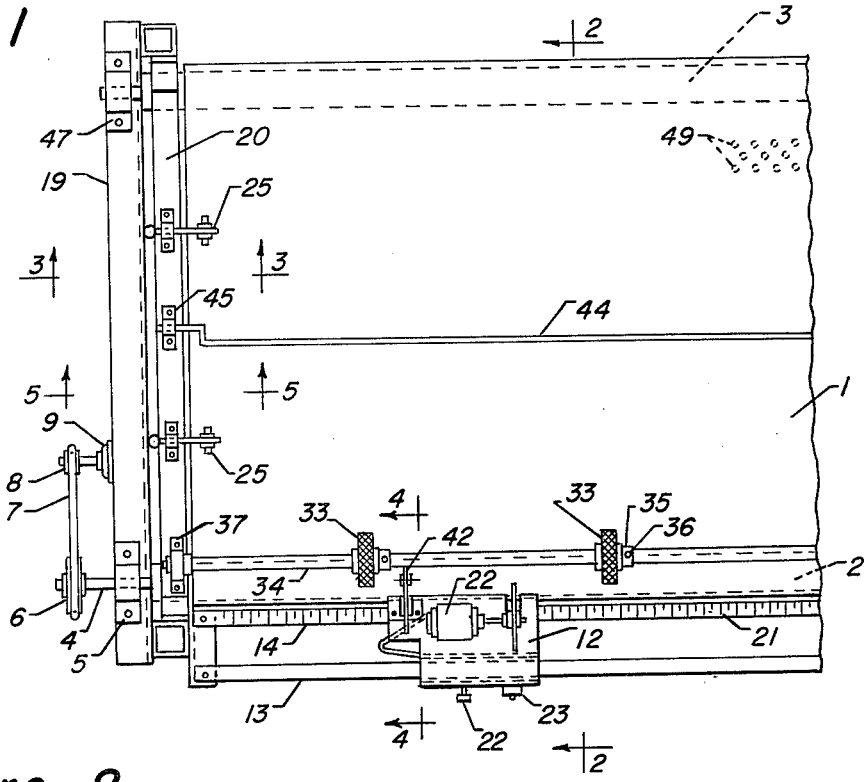
Figure 2
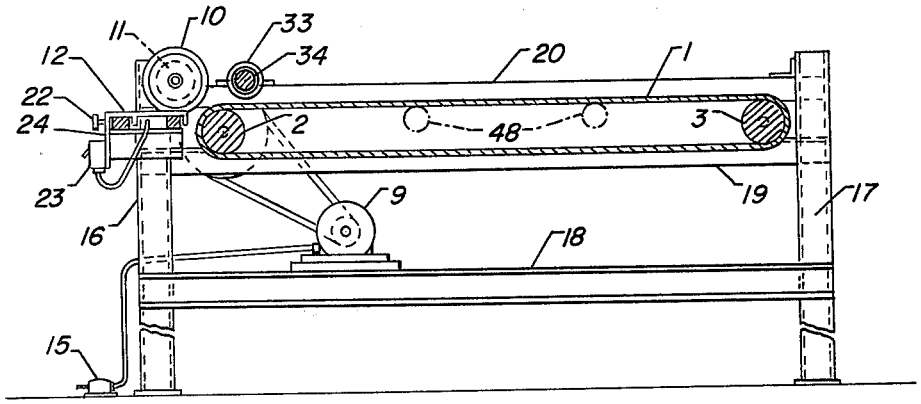
Figure 3
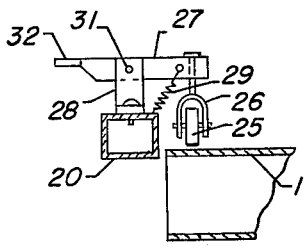
Figure 4
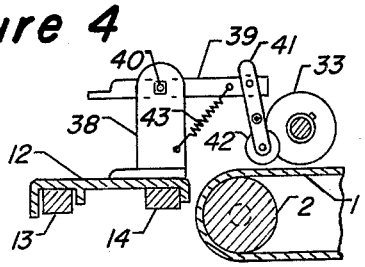
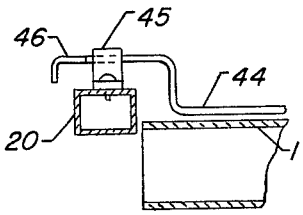
Figure 5

DRAPERY SIZING APPARATUS

The present invention relates to a material squaring and cutting apparatus.

More particularly, the apparatus of the present invention provides for rapidly squaring drapery material as it is carried along on a moving belt type of surface to a movable cutter such that conventional sizing, squaring and cutting times can be vastly reduced.

In the drapery manufacturing business, it has been conventional to use a large, fixed work table having straight edge members at each end of the work surface and at least one of the straight edge members will be movable so as to provide for cutting different lengths of material. In the sizing operation, the material is straightened out on the table and the straight edges used to try and obtain a "squared" piece of material. After the squaring and sizing to measurement, the excess material at one end is cut off to obtain an even length.

This conventional sizing and cutting procedure averages some four minutes of time, even when using persons that are trained and skilled in the operation. This timing may seem relatively short, however, in view of the highly competitive nature of the drapery manufacturing business, it is, of course, necessary to reduce the time involved in each and every step of the overall operation. Thus, where a major handling step, such as the sizing and cutting of squared, even lengths of material, can be accomplished in a fraction of the prior conventional time period involved, then there can be a vast savings in labor and an accompanying competitive advantage in the industry.

In this instance, it may be considered a principal object of the present invention to provide an improved form of sizing and cutting apparatus which can convey the drapery material on a moving belt and along a straight edge such that the material is carried to a powered cutter means, with the entire stage of the operation completed in less than about one-fourth of a minute as compared to about four minutes of time.

It may also be considered an object of the present invention to provide an apparatus which has the cutter along track means positioned such that a powered cutter blade or scissor means will be easily moved and positioned to provide any desired length of drapery material, with the measurement being taken from the straight edge portion of the apparatus and from what will be the top edge of the drapery.

It may be considered a still further object of the invention to have marking means mounted on the track means for the cutter blade such that a suitable marking can be made along the drapery material as it is fed to the edge of the table-like work surface and such markings used to advantage in a subsequent hem making operation.

Other objects and advantages will be set forth hereinafter. In any event, it is to be noted that the improved apparatus will not only provide labor savings and lowered costs, but will provide quality, squared products which can result in truly "custom draperies", as known in the trade.

Broadly, the present invention provides a drapery material alignment and cutting apparatus which comprises in combination: (*a*) a generally horizontal continuous loop-belt member providing a material receiving surface of extended area to accommodate the placement of drapery material; (*b*) drive roller means and belt support means holding said loop-belt member; (*c*) motor means and drive means connective to said drive roller means to effect a desired periodic movement of said belt member and its material receiving surface; (*d*) a straight-edge alignment means along a side of said movable loop-belt member and extending parallel with the movement direction of such belt member whereby material will be aligned to move evenly and in a squared relationship with the movable belt member; (*e*) a material cutter means movably mounted on track means extending perpendicular to the movement of the belt member and adjacent the edge portion of the belt member where the latter moves from the top surface to the bottom to change direction; and (*f*) material hold-down means extending along and over said belt member at a right angle with respect to the straight-edge alignment means, whereby the material being received and moving along with the belt member will in turn be held in a straight perpendicular relationship to the cutter means as it is fed toward the latter.

The loop-belt member which provides the moving table-like surface for handling the drapery material may comprise various types of materials but will generally be fabricated of a rubber or plastic-like material such that it may be passed around spaced apart roller members, one of which will be a driven roller to, in turn, provide for the movement of the belt and the table-like surface. Also, the belt material may have a rubberized interior surface which is against the roller means so as to provide a suitable "friction surface" to be readily driven by the roller means. The driven roller will, of course, connect to suitable electric motor means which in turn may be controlled by a knee operated lever or a foot pedal such that an operator can readily start and stop the movement of the belt and the table-like surface.

The straight edge member which extends along one side of the moving belt surface in order to provide the principle alignment means for the material which is to be fed onto and conveyed by the table may be fabricated or formed from various structural straight edge members. For example, the straight edge alignment means may be the edge of an angle or channel member or may comprise the outer side portion of a square or rectangular-form tubular member. In each apparatus, the straight edge member must be in careful parallel alignment with the edge of the moving belt member and perpendicular to the roller support means for the belt member such that there will be an accurate squaring and straightening of the material fed onto the surface of the conveyor belt-member and, in turn, provide a resulting aligned and squared section of drapery material as it is cut. Generally, in the handling of drapery materials, there will have been a hemmed edge including buckram, or other stiffener material, which provides the top edge of a finished drape. As a result, there is a relatively stiff and rigid edge provided on drapery-types of materials prior to the feeding of the long piece of material into or onto the present type of apparatus for effecting the sizing and cutting of a desired length for a drape.

Various types of electric scissors or cutting wheels may be provided to serve as the cutter means which in turn is mounted on the track means extending along the downstream edge portion of the moving belt member. However, in each instance, the cutter should be mounted or positioned in a manner to engage the drapery material as it reaches the edge of the moving table, as the latter descends around the roller means to make its 180° reverse movement. Separate switch means is also provided that will be readily accessible to an operator to effect the starting and stopping of the cutting means. It should also be noted that it can be of particular advantage to have measurement means directly on the fixed track means for the movable cutter means such that an operator can readily determine the various length measurements from the fixed straight edge means which, in turn, maintains the straight alignment for the top end of the drapery material. Thus, there may be a rapid movement and setting of the cutter means at a desired fixed point on the track means such that there will be a desired length of drape, as measured from the top of the drape along the straight edge means, with the necessary allowance for subsequently making a bottom hem on the drapery material.

As still another added feature in combination with the movable cutter means, there may be a suitable marking member attached to the cutter or to the support means for the cutter means so that at a predetermined measurement away from the cut edge of the material there can be a mark to assist in making the bottom hem. In other words, a suitable mark will be formed on the material as it is conveyed with the moving belt member and such marking will extend across the entire resulting piece of sized and cut material at a predetermined distance up from the cut edge.

The preferred form of the sizing and cutting apparatus will also utilize various material hold-down means to assist in holding the drapery material in a proper aligned position on the moving table-like surface of the belt member. For example, it has been found to be of particular advantage to use spaced knurled surface wheels on a rotatable shaft member that extends along the entire length of the moving belt table-like surface at a location relatively close to the track means such that the material is being held in a straight aligned position as it is conveyed off the downstream edge of the conveying table surface. Also, the knurled wheel members may be made movable along the shaft member so that at least one of the knurled wheels will be relatively close to the cutter means in order to hold the material against the moving belt table-like surface in the zone of the cutting means. Additional smooth rod means may be spaced along the length of the table-like surface, at right angle to the movement of the table, in order to insure the smoothing out of the material and the holding of the material evenly over the entire conveyor belt surface. Such hold-down rods may be adjustable as to height or mounted in such a manner that they can be lifted and rotated in order to preclude excessive weight or pressure against the material, or against the table-like surface.

In still another modification, it has been found to be of advantage to have one or more roller means positioned at spaced distances relatively close to the straight edge alignment member such that the edge of the material which is being conveyed with the belt surface will be held down against the moving surface and there is a resulting mechanical assistance in maintaining the moving material, along with the moving belt member, against the side of the straight edge member to, in turn, insure resulting squared and properly aligned material which will be sized and cut to length by the apparatus.

Reference to the accompanying drawing and the following description thereof will serve to illustrate one embodiment of the present invention as well as assist in pointing out additional advantageous features which are incorporated in the apparatus for effecting the rapid sizing and cutting of drapery materials.

FIG. 1 of the drawing is a partial plan view indicating the placement of a straight edge member along the side of a movable belt member serving as a conveying type of table surface, as well as the positioning of a movable cutter means along track means located in a manner to move at right angles with respect to the belt means.

FIG. 2 of the drawing is a sectional elevational view through the sizing and cutting apparatus, as indicated by the line 2—2 in FIG. 1.

FIG. 3 of the drawing is a slightly enlarged partial sectional view through the straight edge member and a portion of the moving belt member to indicate roller means mounted near the straight edge member for holding material onto the belt surface, as indicated by the line 3—3 in FIG. 1.

FIG. 4 of the drawing illustrates, in an enlarged partial sectional elevational view, a marking means which may be mounted on the cutter support member, as indicated by the line 4—4 in FIG. 1.

FIG. 5 of the drawing illustrates, also in a slightly enlarged partial sectional elevational view, the arrangement of a material hold-down member as being supported from the straight edge member, as indicated by the line 5—5 in FIG. 1.

Referring now particularly to FIGS. 1 and 2 of the drawing, there is indicated the utilization of a continuous loop-belt member 1 to provide a movable table-like surface for the handling of cloth-like materials, particularly for the manufacture of draperies, with such member being supported around spaced roller means 2 and 3. As indicated in the drawing, the roller member 2 will have shaft means 4 extending on through a suitable pillow-block or bearing means 5 and have a sheave or pulley means 6 to connect through belt means 7 to a pulley means 8 on motor means 9 whereby the roller 2 will be powered to move the belt member 1. As best shown in FIG. 2 of the drawing, pulley 2 will be driven counterclockwise to move the top surface of the belt member 1 toward the left and toward a cutter wheel 10 which is mounted from the shaft of a motor means 11 on support 12. The latter is, in turn, being supported by spaced track member 13 and 14. A foot pedal switch 15 connects to motor means 9 such that there may be the easy starting and stopping of the movement of the loop-belt 1 and the conveyance of material thereon to the cutter blade 10.

Various types of supporting structures may be utilized in fabricating the present sizing and cutting apparatus and it is to be realized that the table-like supporting structure of FIGS. 1 and 2 is merely diagrammatic. In this instance, there is indicated the utilization of spaced post means 16 and 17 and cross beams 18 and 19 suitable to hold motor means 9 as well as the bearing means 5 for roller 2 and bearing means 47 for the end of roller means 3 at the upper end portion of the apparatus. In addition, there is the straight edge member 20 which extends between the post means 16 and 17 closely adjacent the side edge of the loop-belt member 1 to serve as the straight edge alignment means to maintain the proper aligning and squaring of material being fed onto the conveying belt surface. As a result, it is necessary that the straight edge member 20 be in an accurate parallel alignment with the movement of the belt member 1 and perpendicular to the roller means 2 and 3 over which the belt member will operate. Suitable posts, cross beams, bearing means, etc., (not being shown) will, of course, be provided at the other end of the apparatus to support the rollers 2 and 3 and other longitudinal members. Also, still other beams or brace members may well be utilized in effecting the suitable support of the sizing and cutting apparatus without effecting the scope of the present invention.

As heretofore noted, it is a particular feature of the present invention to have a mechanical or motor operated cutting means to effect the rapid cutting of the material as it is carried to the downstream edge portion of the belt member 1 and insure the accurate squared cutting of the material with respect to the straight edge alignment member 20. Thus, track means 13 and 14 are necessarily positioned to be perpendicular to the straight edge member 20 and in parallel relationship with the edge of loop-belt member 1 where the surface moves from the top to the bottom, over roller means 2. In this instance, cutter motor 11 and cutter wheel 10, which is attached to the shaft from the latter, is mounted on a slidable support plate 12 which is readily movable along the entire length of the track means 13 and 14 such that any length of drapery material may be cut off as measured from the side of straight edge member 20.

In order to assist in making rapid accurate measurements, there may be suitable markings 21 on the track means 14, or on track means 13, such that support plate 12 and cutter wheel 10 may be moved to a desired predetermined distance from straight edge member 20. A knurled knob, threaded screw member 22, is indicated as extending through a front edge portion 24 of support plate 12 and is positioned to clamp against the side portion of the front track means 13 so that support plate 12 and the acompanying motor and cutter means will be fixedly held at a desired cutting position; however, other conventional locking means may be used to provide for the holding of the cutter means and its supporting plate 12 at a desired location along the track means 13 and 14. Also, it is not intended to limit the present invention to any one type of track means inasmuch as a wide single support member may well be utilized in lieu of the separate spaced apart members 13 and 14 that are presently indicated to provide a suitable support for the cutter means. There is also indicated the placement of a switch means 23 on a front plate portion 24 of support plate 12 in order to provide easily accessible stopping and starting means for the cutter motor 11 and the material cutting operation. Where desired, the switch means for the cutter motor 11 may well be in the form of a foot pedal or a treadle type of switch on the floor of the workroom.

With reference to FIGS. 1 and 3 of the drawing, there is indicated the placement of spaced roller means 25 parallel to and relatively closely adjacent to the side of the straight edge member 20. As best shown in FIG. 3 of the drawing, the roller means 25 may be suspended from shaft means 26 held by a spring biased arm means 27 that is in turn held by post means 28 from straight edge member 20. A spring member 29 is indicated as extending from an end portion of arm 27 to a holding member 30 from straight edge member 20 such that there is a downward biasing of the roller 20 onto the surface of conveyor member 1; while at the same time, by virtue of pin means 31 from post member 28, the pressing of the opposing end portion 32 of arm member 27 will permit the raising of the roller member 25 from above the surface of belt member 1. It has been found that the utilization of the spaced roller means 25 is a particular advantage in holding the material being fed on the belt member in good contact with the latter and against the side of the straight edge member 20 such that the entire piece of material extending outwardly over the surface of the continuous belt loop member 1 can be maintained in a squared, aligned relationship with the straight edge member 20.

It has also been found that knurled surface wheel members 33, shown as mounted from shaft 34, that extends parallel with the track means 13 and 14 above the surface of loop member 1, will assist in holding the downstream portion of the drapery material against the loop-belt surface 1 and assist in the overall squaring and aligning of the material on the conveyor belt surface. As heretofore noted, it is of advantage to have at least one of the knurled wheel members 33 relatively close to the zone of cutting wheel 10 such that the material is being properly held at the zone of the material cutting operation. Thus, in order to have adjustability of positioning for the knurled wheel members 33, such members may have hub portions 35 and set screw means 36 to permit longitudinal adjustability along the length of shaft means 34. The latter is in turn indicated as being held by suitable pillow-block means 37 from the top surface of straight edge member 20. Normally, it is unnecessary to have the shaft means 34 power operated inasmuch as it may merely idle or rotate responsive to the movement of the material and the power operated loop-belt member 1.

As still another advantageous feature of the present apparatus, there may be the utilization of a suitable marking member in combination with the support plate 12 or the motor for cutter means 10 whereby a mark may be provided across the width of the drapery material at a predetermined distance from the cut edge. For example, where it is known that some 8 to 15 inches of material are required to provide a hem from the cut edge of the material, then the marking means will be located to be at the predetermined distance from the cut of the material and result in assisting in the subsequent hemming of the drapery material. Specifically, as best shown in FIG. 4 of the drawing, there is diagrammatically indicated the placement of post-like support means 38 along the cutter support plate 12 and a pivot arm means 39 from pin member 40 such that depending arm means 41 may hold a marking wheel 42 that is adapted to move across the material being conveyed on loop-belt member 1. It will also be noted that spring means 43 is utilized between the end portion of the arm member 39 and the lower portion of post member 38 such that there is a downward spring biasing to provide pressure from the marking wheel 42 onto the material passing under such wheel. The present drawing is merely diagrammatic and other methods of supporting a marking means may well be employed. Also, the marking need not be from a wheel member 42 but may be made from a fixed piece of chalk or from conventional material marking means. The support for the marking means may also be adjustably mounted on the plate 12 to provide a varying dimension from the cut edge.

As still another aspect, there is diagrammatically indicated the placement and utilization of additional longitudinal positioned hold-down means such as smooth bar means 44 which, as best shown in FIG. 5, is supported from clamping means 45 mounted from the top of straight edge member 20. The support member 45 may be provided in a manner to permit rotation of member 44 whereby it can be raised or lowered with respect to the top surface of conveyor belt member 1 by virtue of twisting an end portion 46. Typically, the elongated bar member 44, as shown in FIG. 1, will be spaced slightly above the surface of the conveyor loop-belt member 1 such that material can pass therebetween but will be smoothed and held against the conveyor belt surface as it is carried therewith to the cutting edge of the apparatus. Actually, a plurality of hold-down members 44 may be spaced one from another across the length of the table-like surface of the apparatus such that there is assistance in smoothing and holding material over the entire length of the apparatus.

Minor modifications in construction and operation will be apparent to those skilled in the construction and use conveyor means and in the handling of cloth materials. For example, spaced idle rollers, such as 48, are indicated in FIG. 2 of the drawing to assist in the support of the upper portion of the moving belt 1 in order to maintain a relatively flat and smooth table-like surface for the conveying of the drapery material. Additional rollers may also be utilized under the lower return portion of the loop-belt member 1; however, such types of rollers are not indicated in the present drawing. Various types of materials may well be used in fabricating the continuous loop-belt member as well as various portions of the entire apparatus. Typically, the loop-belt member may comprise a reinforced rubber-like material capable of being powered and carried over the spaced rollers 2 and 3. Specifically, the belt material may comprise "Hycar" belting with a smooth top finish and a frictional surface on the pulley side. In each instance, the motor power means for powering the drive roller 2, the motor means for the cutter blade 10, and the pulley and belt arrangements, as well as the switch means indicated, are merely diagrammatic and other conventional motor drive means and control means may well be utilized within the scope of the invention.

In the use of the apparatus, operators will be positioned on each side of the continuous loop-belt member such that material can be fed onto the leading edge of the conveyor table-like surface and maintained against the side of the straight edge member 20 and such that an operator will be adjacent the cutter means and the switching means which will operate the movement of the conveyor loop-belt means 1 and the cutter blade 10. Of course, the positioning of the support plate 12 and the cutter thereon will be preset to be fixed at a proper dimension to suit the desired length of drapery, as measured from the straight edge 20. By virtue of the straight edge, the various hold-down rollers and the bar means such as 44, the material being conveyed on the loop-belt member will be retained in a squared and properly aligned positioning such that there is a resulting straight, right angle cut across the bottom of the drapery material. In the event that long lengths of drapery are required, it may be necessary to have two operators on each side of the sizing and cutting apparatus such that the material is uniformly fed onto the conveyor surface and maintained in alignment along the straight edge member as well as being maintained in alignment on the downstream edge of the loop-belt member while being fed into the cutter means.

As still another modification which may be used to advantage, there may be the use of a perforated loop-belt member and air suction means provided to effect a relatively uniform suction through the top surface and on the material being fed onto the conveyor belt means so as to assist in holding the material tightly to the surface. The air intake duct means below the top surface of the loop-belt means can be conventional and can connect to the intake of a blower to effect the desired suction effect through the belt and on to the material. Perforations are indicated diagrammatically at 49 in FIG. 1 of the drawing; however, conventional air intake duct means to extend under the top of belt 1 and which would lead to fan intake means has not been shown, as such duct work could vary and would be obvious to one skilled in installing suction means.

I claim as my invention:

1. A drapery material alignment and cutting apparatus which comprises in combination:

a. a generally horizontal continuous loop-belt member providing a material receiving surface of extended area to accommodate the placement of drapery material;

b. drive roller means and belt support means holding said loop-belt member;

c. motor means and drive means connective to said drive roller means to effect a desired periodic movement of said belt member and its material receiving surface;

d. a continuous straight-edge alignment means along one side of said movable loop-belt member and extending parallel with the movement direction of such belt member whereby material of varying lengths can be aligned to move evenly and in a squared relationship with the movable belt member;

e. a material cutter means movably mounted on a dimensioned track means separate from said alignment means and extending perpendicular to the latter and to the movement of the belt member and adjacent the edge portion of the belt member where the latter moves from the top surface to the bottom to change direction; and f. material hold-down means extending along and over said belt member for the full width thereof and at a right angle with respect to the straight-edge alignment means, whereby the material being received and moving along with the belt member will in turn be held in a straight perpendicular relationship to the cutter means as it is fed toward the latter for the cutting of a desired length measured from said straight-edge alignment means.

2. The alignment and cutting apparatus of claim 1 further characterized in that a pressure operated switch means connects to the motor means for the drive roller effecting the periodic movement of the belt member, whereby an operator can affect the easy starting and stopping of the belt member.

3. The alignment and cutting apparatus of claim 1 further characterized in that spaced rotatable knurled surface wheel members are provided along a longitudinal shaft means extending parallel to and over the surface of the continuous loop-belt member adjacent the track means, whereby such wheel members will assist in holding material against the top surface of the belt member in a straight alignment.

4. The alignment and cutting apparatus of claim 1 further characterized in that spaced roller means are provided along and closely adjacent to the side of said straight edge alignment means in a position whereby the rollers can contact material moving on the surface of the continuous loop-belt member and assist in holding such material on the surface thereof and against said alignment means.

5. The alignment and cutting apparatus of claim 1 further characterized in that said movably mounted material cutter means comprises a motor operated circular blade positioned to be parallel with said straight edge means and at right angles with respect to the belt member where it passes over a support roller, whereby the material will be cut in a straight line parallel to the straight edge means.

6. The alignment and cutting apparatus of claim 1 further characterized in that measurement markings are provided along the length of said track means whereby there may be the rapid setting of the cutter means thereon to provide desired measured lengths of material from said straight edge means.

* * * * *